US010989397B2

(12) United States Patent
Zhang et al.

(10) Patent No.: US 10,989,397 B2
(45) Date of Patent: Apr. 27, 2021

(54) TRACK-LIGHT FIXTURE

(71) Applicant: Green Creative, LTD, Hong Kong (CN)

(72) Inventors: Ryan Zhang, Shanghai (CN); Bertrand Delalande, Shanghai (CN)

(73) Assignee: Green Creative Ltd, Hong Kong (CN)

( * ) Notice: Subject to any disclaimer, the term of this patent is extended or adjusted under 35 U.S.C. 154(b) by 0 days.

(21) Appl. No.: 16/501,896

(22) Filed: Jul. 1, 2019

(65) Prior Publication Data

US 2021/0003272 A1 Jan. 7, 2021

(51) Int. Cl.

| | |
|---|---|
| ***F21V 21/35*** | (2006.01) |
| ***F21V 29/74*** | (2015.01) |
| ***F21Y 115/10*** | (2016.01) |
| ***F21V 23/00*** | (2015.01) |

(52) U.S. Cl.

CPC ..... *F21V 21/35* (2013.01); *F21V 23/009* (2013.01); *F21V 29/74* (2015.01); *F21Y 2115/10* (2016.08)

(58) Field of Classification Search

CPC ..... F21S 8/038; F21S 8/066; F21V 21/35; F21V 23/009; F21V 29/74; F21V 29/773; F21Y 2115/10

See application file for complete search history.

(56) References Cited

U.S. PATENT DOCUMENTS

2005/0128752 A1* 6/2005 Ewington ..... F21S 4/28 362/294
2007/0029456 A1* 2/2007 Mier-Langner ..... F21V 17/107 248/342
2011/0181200 A1* 7/2011 Luk ..... H05B 45/20 315/294
2013/0128561 A1* 5/2013 Thomas ..... F21V 21/30 362/157
2013/0201697 A1* 8/2013 Osada ..... F21K 9/20 362/373
2014/0092582 A1* 4/2014 Keser ..... F21V 19/00 362/95
2015/0137683 A1* 5/2015 Krames ..... F21V 23/008 315/113
2015/0184841 A1* 7/2015 Liu ..... F21S 8/038 362/270

FOREIGN PATENT DOCUMENTS

DE 102008055864 A1 * 5/2010 ..... F21S 8/038
DE 202016101343 U1 * 3/2016 ..... F21V 21/34

OTHER PUBLICATIONS

Machine translation of DE202016101343U1 (Year: 2016).*
Machine translation of DE 10 2008 055 864 (Year: 2010).*

* cited by examiner

*Primary Examiner* — Leah Simone MacChiarolo
(74) *Attorney, Agent, or Firm* — James A. Gavney, Jr.; JAG Patent Services

(57) ABSTRACT

A LED track-light fixture is disclosed. The LED track-light fixture includes a canister assembly and a LED light module. The LED light module includes a LED light engine surrounded by a heat sink with vertical cooling fins fit into the canister assembly. The LED light module electrically couples to a driver assembly therein through matched sets of contact connectors. The canister assembly and a LED light module have matched guide features to ensure that the LED light module is installed in the proper rational orientation and the LED light module is preferably secured within the canister assembly through a fixing ring structure.

10 Claims, 4 Drawing Sheets

TRACK-LIGHT FIXTURE

FIELD OF THE INVENTION

This invention relates to track-lighting. More particularly, the present invention relates to a track-light fixture.

BACKGROUND OF THE INVENTION

Track-lighting refers to light fixtures that are cable of being attached anywhere along a continuous electrified track; in contrast to lighting that usually requires electrical wiring to each individual light fixture position. Track-lighting has the advantage of being capable of being mounted to a variety of structural surface, such as ceilings, walls, beams and rafters.

Typical track-lighting systems have a line voltage running through a recessed track or power track. The power track may have more than one live conductor, so that multiple switching circuits can be used to control different lights operating from the same power track. Systems often operate with low voltage (10, 12, or 24 volts). In this case, the power track is electrified through a low-voltage transformer. Some newer track-lighting systems use a single live conductor and a suitable digital control interface, such as DALI to control each adapter coupled to the track.

Track-lighting systems have traditional used halogen MR (multifaceted reflector) light engines because they have a small form factor and still provide bright directional lighting. A typical MR light engine has a two prong connector or connector pins and are produced in a variety of different sizes. A common MR light engine used in track-lighting systems is a MR16 light engine, wherein the number 16 represents the diameter of the light engine in eighths of an inch. Halogen MR light engines are largely being replaced by longer lasting and more efficient LED light engines.

SUMMARY OF INVENTION

The present invention is directed to a track-light fixture configured to be used any type of track-light system including, but not limited to, "H", "J", and "L" type track-light systems. The track-light fixture includes a canister housing that forms an enclosed channel with openings at a first end and a second opposite end. The canister housing can have any suitable shape, but is preferably cylindrically-shaped.

The track-light fixture has a driver assembly that includes a driver circuit housing with a connector stage. The driver circuit housing houses a driver circuit with electrical connections that are accessible from the connector stage. The connectors are preferable two female plug-in type connectors, hereafter plug-in connectors, positioned within the canister housing and facing toward the second and opposite end of the canister housing and are configured for receiving two matched male prong connectors, hereafter pin connectors, on a LED light module, such as described below. The driver assembly also includes a back plate cover the encloses the driver circuit within the driver circuit housing. The back plate can include clips, screws or any other suitable attachment means for attaching or securing the back plate to the driver circuit housing.

Protruding from the surface of the connector stage and surrounding the plug-in connectors there are a set of spring clips and a set of safety stop features. The spring clips help align plug-in connectors on the connector stage of the driver assembly with the pin connectors on the LED light module during installation. The safety stop features help to prevent improper installation of a LED light engine or installation of a non-conforming light engine, such as a halogen MR-16 light engine.

The track-light fixture also includes a track adapter arm. The track adapter arm electrically couples to the driver assembly via the driver circuit to provide power to a LED light engine or lamp through, for example, "H", "J", and "L" type power tracks or any other suitable power track.

The track-light fixture of the present invention also includes a LED light module with a LED light engine or lamp. The LED light module has pin connectors, such as described above, protruding from a connector base of the LED light module for electrically coupling to the plug-in connectors on the connector stage of the driver assembly. The LED light engine module further includes a heat sink structure that surrounds the LED light engine or lamp to provide cooling.

The heat sink structure, for example, has vertical fins that from the heat sink structure with a shape similar to that of canister housing. Wherein the canister housing is a cylindrically-shaped canister housing, the heat sink structure is also preferably cylindrically-shaped. The heat sink structure is preferably made from a material, such as aluminum or a metal alloy, which is sufficiently conductive to remove and disperse heat away from the LED light engine or lamp.

In operation, a LED track light canister assemble is formed from a track adapter arm, connected to a driver assemble that is positioned within first end of a canister housing. The LED light module is inserted within the second and opposite end of the canister housing with matched guide features on the LED light module and the canister housing aligned. The LED light module is pushed into the canister housing such that the plug-in connectors on the connector stage of the driver assembly and the pin connectors on the LED light module electrically connect and the spring clips engage the connector base on the LED light module. A fixing ring structure with securing tabs or guiding tabs is position with the securing tabs or guiding tabs positioned within match slotted features on a face plate of the LED light module. Clips or snap features on the fixing ring structure are positioned within an edge ridge on the canister housing. The fixing ring structure is then turned or rotated to secure the LED light module within the canister housing. To change the LED light module, the fixing ring structure is turned or rotated in an opposite direction and the fixing ring structure and the LED light module is removed from the canister housing of the track light canister assembly.

DETAILED DESCRIPTION OF THE INVENTION

Figure 1:
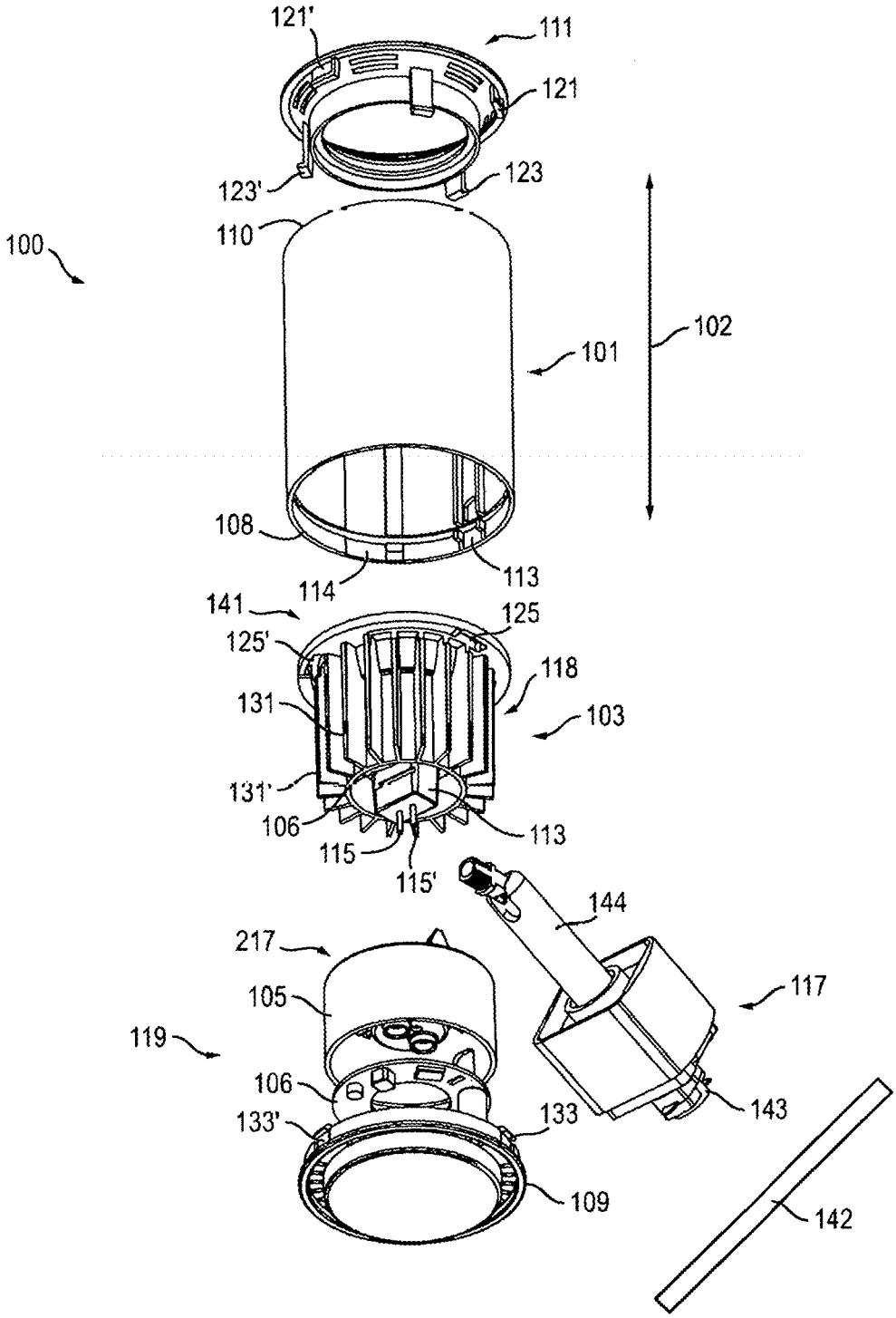
FIG. 1 shows an exploded view of a track-light fixture, in accordance with the embodiments of the invention.

Referring to FIG. 1 shows an exploded view 100 of a track-light fixture of the present invention. The track-light fixture has a driver assembly 119. The driver assembly has a driver circuit housing 105 with a connector stage 217. The driver circuit housing 105 houses a driver circuit 106 with electrical connectors 216 and 216' (FIG. 2) that are accessible from the connector stage 217. The electrical connectors 216 and 216' are preferable female plug-in connectors. The driver assembly 119 also includes a back plate cover 109 the encloses the driver circuit 106 within the driver circuit housing 105. The back plate cover 109 can include clips, screws or any other suitable attachment means for attaching or securing the back plate cover to the driver circuit housing 105.

Figure 2:
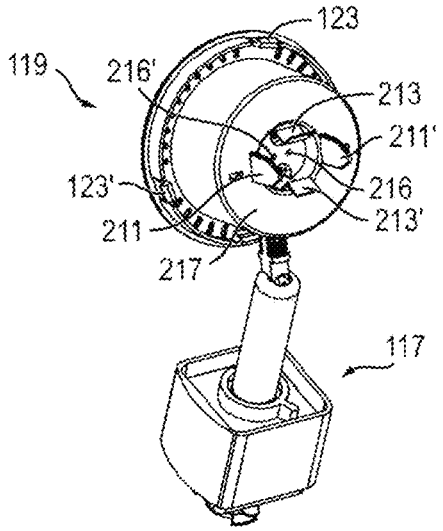
FIG. 2 shows a diver housing assembly with spring clip features, safety stop features and a track adapter arm, in accordance with the embodiments of the invention.

Referring to FIG. 1 and FIG. 2, protruding from the connector stage 217 and surrounding the plug-in connectors 216 and 216' there are sets of spring clips 213 and 213' and safety stop features 211 and 211'. The spring clips 213 and 213' help align the plug-in connectors 216 and 216' on the connector stage 217 of the driver assembly 119 with the pin connectors 115 and 115' on a LED light module 103 during installation. The safety stop features 211 and 211' help to prevent improper installation of a LED light engine or installation of an non-conforming light engine, such as a halogen MR-16 light engine. In further embodiments of the invention, the spring clips 213 and 213' and the safety stop features 211 and 211' are the same structure and are positioned where the spring clips 213 and 213' are shown and protrude to a distance similar to the distance of the safety stop features 211 and 211' are shown.

Referring again FIG. 1, the LED light module 103 has a LED light engine or lamp 106 with the pin connectors 115 and 115' protruding from a connector base 113 of the LED of the LED light engine or lamp 106 for electrically coupling to the plug-in connectors 216 and 216" on the connector stage 217 of the driver assembly 119, as described above. The LED light module 103 further includes a heat sink structure 118 that surrounds the LED light engine 106 to provide cooling. The heat sink structure 118, for example, has a fins 131 and 131' that extend in a vertical direction 102 and are referred to, herein, as vertical fins. The vertical fins 131 and 131' form the heat sink structure 118 with a shape that is similar to that of a canister housing 101. Wherein the canister housing 101 is a cylindrically-shaped canister housing, the heat sink structure 118 is also preferably cylindrically-shaped. The heat sink structure 118 is preferably made from a material, such as aluminum or a metal alloy or any other material, that is sufficient conductive to remove and disperse heat away from the LED light engine or lamp 106.

Figure 3:
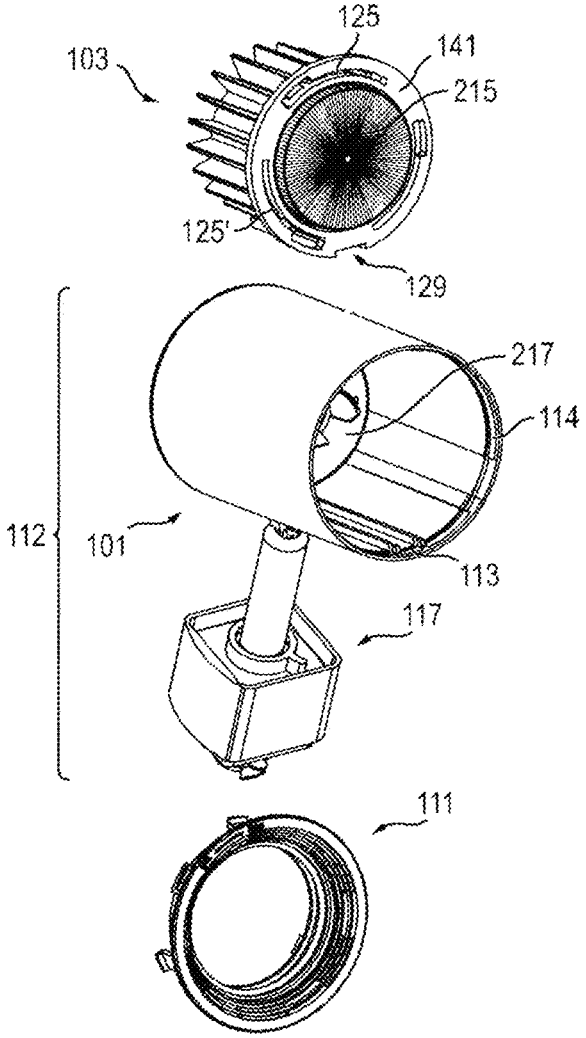
FIG. 3 shows track-light assembly, a LED light module and fixing ring structure, in accordance with the embodiments of the invention.
Figure 4A:
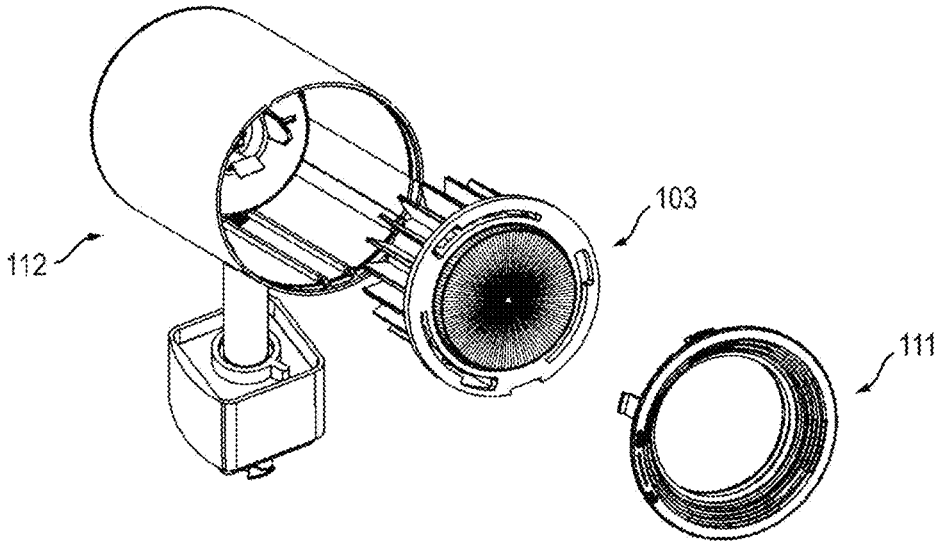
FIGS. 4A-D illustrate installation and replacement of a LED light module in the LED track-light fixture, in accordance with the embodiments of the invention.
Figure 4B:
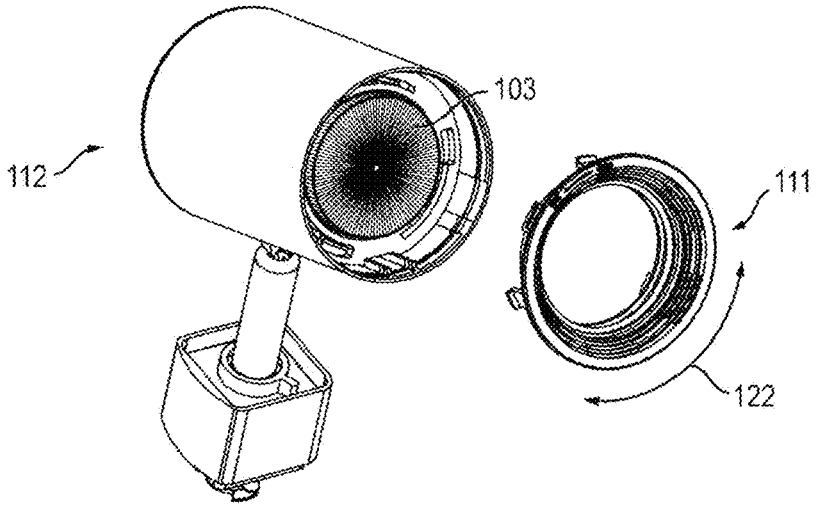
Figure 4C:
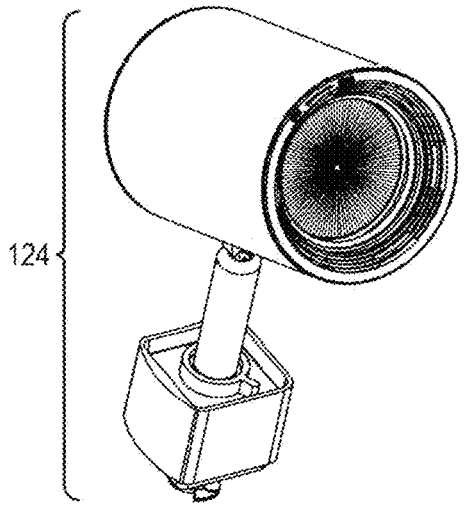
Figure 4D:
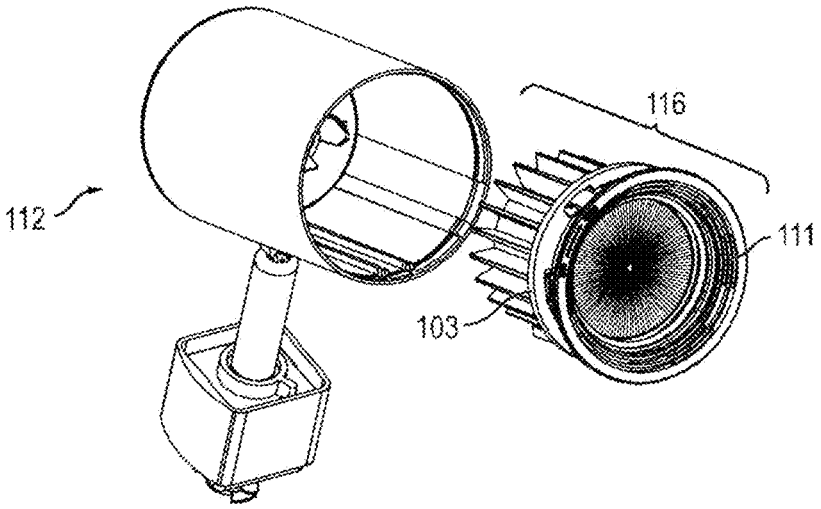

Preferably, LED light module includes a the face plate 141 with slotted features 125 and 125' that are used to secure the LED light engine within the canister housing 101 using a fixing ring structure 111, such as described below. The fixing ring structure 111 preferably has securing tabs or guiding tabs 123 and 123' and clips or snap features 121 and 121'. The LED light module can also include and suitable lens 215 (FIG. 3) to diffuse or focus light emitted from the LED light module 103.

The LED track-light fixture also includes a track adapter arm 117. The track adapter arm 117 includes a connector shaft 144 track connector 143. The track adapter arm 117 electrically couples to the driver assembly 119 to provide power to the LED light engine or lamp 106 through a suitable power track 142. FIG. 2 shows the driver assembly 119 electrically coupled to the track adapter arm 117.

Referring to FIG. 1, FIG. 2, FIG. 3 and FIGS. 4A-D the LED light fixture 124 of the present invention is formed by positioning the driver assembly 119 within a first end 108 (FIG. 1) of the canister housing 101 and attaching the driver assembly 119 thereto by any suitable attachment means such as clip features 133 and 133' to form a LED track light canister assemble 112. In this configuration the plug-in connectors 216 and 216' on the connector stage 217 of the driver assembly 119 are assessable through a second and opposite end 110 (FIG. 1) of the canister housing 101. A LED light module 103, such as described above, is inserted within the second and opposite end 110 of the canister housing 101 with matched guide features 129 and 113, also referred to herein as matched vertical guide features) on the LED light module 103 and the canister housing 101 aligned. The matched guide features 129 and 113 ensure that the LED light module 103 is positioned within the canister housing in a fixed rotational orientation and such that the plug-in connectors 216 and 216" on the connector stage 217 of the driver assembly 119 and the pin connectors 115 and 115' on the connector base 113 of the LED light engine or lamp 106 align during installation of the LED light module 103.

The LED light module 103 is pushed within the canister housing 101 such that the plug-in connectors 216 and 216' on the connector stage 217 of the driver assembly 119 and pin connectors 115 and 115' protruding from the connector base 113 of the LED light engine or lamp 106 on the LED light module 103 electrically connect or couple and the spring clips engaging the connector base 113. Then the fixing ring structure 111 is positioned with the securing tabs or guiding tabs 123 and 123' within match slotted features 125 and 125' on the face plate 141 of the LED light module 103. Clips or snap features 121 and 121' on the fixing ring 111 are engaged with an edge ridge 114 on the opposite and second end 110 of the canister housing 103. The fixing ring structure 111 is then turned or rotated as indicated by the arrow 122 (FIG. 4B) to secure the LED light module 1103 within the canister housing 103 of the LED track light canister assemble 112 and form the LED track-light fixture 124 of the present invention. To change or replace the LED light module 103, the fixing ring structure 111 is turned or rotated in an opposite direction 122 and the LED the light module/fixing ring assembly 116 is removed from the canister housing 103 the LED track light canister assemble 112 and a replacement LED light module is installed, as described above.

The present invention has been described in terms of specific embodiments incorporating details to facilitate the understanding of the principles of construction and operation of the invention. For example, the LED track-light fixture can have any number of shapes including, but not limited to circular shapes, rectangular shapes and other geometric shapes. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A track-light fixture comprising:

a) a canister housing;

b) a driver assembly that fits within a first end of the canister housing with two plug-in connectors facing towards a second and opposite end of the canister housing; and c) a LED light module with a LED light engine having two pin connectors for electrically coupling to the two plug-in connectors on the driver assembly within the canister housing, the LED light engine module further comprising a cylindrical heat sink structure with vertical fins that surround the LED lamp and that fit within the second and opposite end of the canister housing to form the track-light fixture, wherein the canister housing and the LED light module have matched vertical guide features that ensure the LED light module is fitted within the canister housing in a single and fixed rotational orientation and wherein driver assembly has safety stop features that surround the two plug-in connectors to prevent installation of a non-conforming light engine with two pin connectors and spring clip features protruding from connector stage and surrounding the two plug-in connectors that secure the LED light module to the two plug-in connectors.

2. The track-light fixture of claim 1, future comprising a track adapter arm that electrically couples to the driver assembly to power the LED light engine through a power track.

3. The track-light fixture of claim 1, further comprising a fixing ring structure for securing the LED light module within the canister housing through securing tabs and clips.

4. The track-light fixture of claim 3, wherein the LED light module has a face plate with slotted features for receiving the securing tabs and securing the LED light module within the canister housing by turning or rotating the fixing ring.

5. A track-light fixture comprising:

a) a canister housing with driver assembly having a connector stage with two plug-in connectors facing within the canister housing; and b) a LED light module that fits within the canister housing to electrically couples to the two plug-in connectors, wherein the canister housing and the LED light module have matched guide features to ensure the LED light module is fitted within the canister housing in a single and fixed rotational orientation and wherein the connector stage has safety stop features protruding therefrom to prevent installation of a non-conforming light engine with two pin contacts and spring clip features protruding from connector stage and surrounding the two plug-in connectors that secure the LED light module to the two plug-in connectors.

6. The track-light fixture of claim 5, wherein the LED light module includes a LED light engine that is surrounded by a cylindrically-shaped heat sink with vertical fins.

7. The track-light fixture of claim 5, wherein the LED light module includes a face plate feature with slotted features that engage securing tabs on a fixing ring for securing the LED light module within the canister housing by rotating the fixing ring with the securing tabs engaged with the slotted features.

8. The track-light fixture of claim 5, future comprising a track adapter arm that electrically couples to the driver assembly to power the LED light module through a power track.

9. A track-light fixture comprising:

a) a cylindrically-shaped canister with a driver assembly fitted to a first end of the cylindrically-shaped canister such that a connector stage of the driver assembly faces within the cylindrically-shaped canister;

b) a cylindrical-shaped LED light module with a LED lamp surrounded by a heat sink with vertical fin structures, the cylindrical-shaped LED light module being configured to fit within a second and opposite end of the cylindrical-shaped canister to electrically couple to driver assembly; and c) a track adapter arm that electrically couples to the driver assembly to power the LED lamp through a power track, wherein the cylindrically-shaped canister and the cylindrical-shaped LED light module have matched guide features that ensure cylindrical-shaped LED light module fits within the second and opposite end of the cylindrical-shaped canister in a single and fixed rotational orientation and wherein the connector stage of the driver assembly has protruding safety stop features surrounding two plug-in connectors to prevent installation of a non-conforming light engine and protruding spring clips adjacent to the safety stop features and surrounding two plug-in connectors to that secure the LED light module to the two plug-in connectors.

10. The track-light fixture of claim 9, wherein the cylindrical-shaped LED light module includes a face plate feature with slotted features that engaged securing tabs on a fixing ring for securing the LED light module within the second and opposite end of the cylindrically-shaped canister by rotating the fixing ring with the securing tabs engaged.

* * * * *